US011932948B2

(12) United States Patent
Horner et al.

(10) Patent No.: US 11,932,948 B2
(45) Date of Patent: Mar. 19, 2024

(54) ELECTROLESS NICKEL ETCH CHEMISTRY, METHOD OF ETCHING AND PRETREATMENT

(71) Applicant: Hutchinson Technology Incorporated, Hutchinson, MN (US)

(72) Inventors: Matthew J. Horner, Savage, MN (US); Gowtham V. Vangara, Clifton Park, NY (US); Douglas P. Riemer, Waconia, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 85 days.

(21) Appl. No.: 17/512,511

(22) Filed: Oct. 27, 2021

(65) Prior Publication Data

US 2022/0127729 A1 Apr. 28, 2022

Related U.S. Application Data

(60) Provisional application No. 63/106,827, filed on Oct. 28, 2020.

(51) Int. Cl.
*C23F 1/30* (2006.01)

(52) U.S. Cl.
CPC ..... *C23F 1/30* (2013.01)

(58) Field of Classification Search
None
See application file for complete search history.

(56) References Cited

U.S. PATENT DOCUMENTS

| | | | | |
|---|---|---|---|---|
| 4,302,246 | A | 11/1981 | Brindisi, Jr. et al. | |
| 4,455,364 | A * | 6/1984 | Sasa | C23F 1/02 430/323 |
| 4,554,049 | A * | 11/1985 | Bastenbeck | C23F 1/44 134/41 |
| 4,608,091 | A | 8/1986 | Sullivan et al. | |
| 4,720,332 | A | 1/1988 | Coffey | |
| 6,642,199 | B2 | 11/2003 | Humphreys et al. | |
| 8,891,206 | B2 | 11/2014 | Miller | |
| 9,296,188 | B1 | 3/2016 | Cray et al. | |
| 9,541,769 | B2 | 1/2017 | Ladwig et al. | |

FOREIGN PATENT DOCUMENTS

| | | | | |
|---|---|---|---|---|
| CA | 3013056 C | * | 7/2020 | C11D 1/83 |
| JP | 2005023340 A | * | 1/2005 | |
| JP | 2013089630 A | * | 5/2013 | |
| KR | 20200060962 A | * | 1/2020 | |
| KR | 20210138423 A | * | 1/2021 | |

* cited by examiner

*Primary Examiner* — Allan W. Olsen
(74) *Attorney, Agent, or Firm* — DLA Piper LLP (US)

(57) ABSTRACT

Etchant solutions, pretreatment and methods for etching electroless nickel on metallic materials are provided herein. More specifically, etchant solutions for selectively removing electroless nickel from the surface of metallic materials containing copper, and optionally as containing stainless steel, methods of etching and pretreatment are provided.

9 Claims, 7 Drawing Sheets

Ethylene diamine tetraacetic acid
(EDTA)

$H_2O_2$

Hydrogen peroxide

Sodium m-nitrobenzoate
(NBCA)

ELECTROLESS NICKEL ETCH CHEMISTRY, METHOD OF ETCHING AND PRETREATMENT

CROSS-REFERENCE TO RELATED APPLICATIONS

This application claims the benefit of, and priority to, U.S. Provisional Application No. 63/106,827 filed on Oct. 28, 2020, which is hereby incorporated by reference in its entirety.

TECHNICAL FIELD

Embodiments of the present disclosure relate generally to chemistry and methods for etching electroless nickel on metallic materials. More specifically, embodiments of the present disclosure relate to an etchant solution for selectively removing electroless nickel from the surface of metallic substrates or structures containing copper and optionally stainless steel, methods of etching and pretreatment.

BACKGROUND

Electronic circuits, such as printed circuit boards and the like are used in a wide range of components, and typically include conductive and insulating layers. For example, in the disk drive industry, flexures are structures that flexibly support a read/write transducer proximate a rotating disk, while also supporting flexible electrical circuitry for conducting electrical signals to and from the transducer. In some structures, a layer of stainless steel is included, sometimes as a base layer, upon which various insulating and conductive layers are formed.

Copper is widely used as a conductive layer, which is typically patterned and etched to form copper conductive traces. In some manufacturing processes, electroless nickel (E-Ni) is deposited on the copper traces to prevent oxidation of the copper. When a stainless steel layer is also present, the electroless nickel also deposits on the stainless steel due to galvanic effects in the plating bath. FIG. 1A and FIG. 1B show an electronic component before and after electroless nickel deposition, respectively. Typically, a polyimide overcoat is applied, and then the electroless nickel needs to be removed from the copper traces and stainless steel.

Removal of electroless nickel from copper and stainless steel poses many challenges. In particular, it is difficult to remove eletroless nickel from desired areas without affecting or damaging the underlying surfaces. The inventors have observed that many commercial etchants are unable to remove the nickel in a reasonable time period, if at all.

For example, commercial etchants that are effective at removing the nickel severely attack the copper surfaces. Further complicating the problem is that the presence of the stainless steel creates galvanic coupling between the nickel and the stainless steel in the etchant bath (creating a battery effect), which causes a preference for etching the stainless steel over the nickel. One way to address this issue is to make the etchant bath more aggressive, but that in turn causes a substantial loss of the copper layer.

Another problem encountered is the development of an oxide on the surface of the nickel layer. This oxide is tenacious and difficult to remove. One way to address this problem is to make the etchant bath more aggressive, but again this causes a substantial loss of the copper layer.

Thus, selective removal or etching of electroless nickel from the surface of metallic materials containing stainless steel is a significant and complicated problem. Commercially available etchants are substantially ineffective or undesirable. According, new developments are greatly needed.

SUMMARY

Broadly, embodiments of the present disclosure provide etchant solutions for selectively removing electroless nickel from the surface of metallic substrates, including substrates or structures containing cooper, and optionally stainless steel, methods of etching and pretreatment of the surfaces.

The inventors have discovered that a number of complex factors must be understood with respect to the chemistry of the etchant bath in order to solve the aforementioned problems. After substantial study and effort, the inventors have developed an innovative etchant solution that is comprised of a combination of chemicals that synergistically: (1) etch an electroless nickel layer on a copper layer, including in instances where stainless steel is also present, (2) remove an oxide that forms on the surface of the nickel layer, and (3) reduce etching of the copper layer as the surface of the copper is exposed. The inventors have discovered that the presence of the stainless steel alters the electrical system within the etchant bath, and that a variety of competing mechanisms must be balanced and promoted in the etchant bath in order to provide effective and desirable selective etching of the nickel layer while reducing or prevent etching of the copper layer, including when stainless steel is present and/or electrically connected.

In some embodiments, an etchant solution for removing or etching electroless nickel from a copper layer is provided wherein the etchant solution comprises a combination of chemical component that act synergistically to: etch the electroless nickel preferentially, remove an oxide that forms on a surface of the nickel layer, and reduce etching of the copper layer as the surface of the copper layer is exposed. In some embodiments, the copper layer is formed atop of stainless steel, and the etchant solution removes electroless nickel from the copper layer in the presence of stainless steel.

For example in some embodiments, an etchant solution is provided, comprising: hydrogen peroxide, sodium m-nitrobenzoate (NBCA) and ethylenediamine tetra acetic acid (EDTA). In some embodiments, the molar concentration of the components in the etchant solution are in the range of about 3.0-4.0 M hydrogen peroxide, 0.4-0.5 M NBCA and 0.05-0.10 M EDTA.

In another aspect, embodiments of the present disclosure provide methods of removing or etching electroless nickel on at least one surface of a substrate, the substrate including copper and optionally stainless steel, comprising the steps of: exposing the substrate to an etchant solution comprising hydrogen peroxide, sodium m-nitrobenzoate (NBCA) and ethylenediamine tetra acetic acid (EDTA), and etching the electroless nickel on the surface of the substrate to remove the electroless nickel.

In another aspect, the inventors have discovered a unique pretreatment process that enhances the etching of electroless nickel on a substrate, and in particular improves removal of oxide that forms on the nickel and increases etching speed. The inventors have also discovered that the pretreatment process provides a more uniform etch initiation such that over-etching is avoided. This enhanced effect was unexpected. For example in some embodiments, a substrate, typically including copper and optionally but not necessarily containing stainless steel, is treated with a pretreatment solution comprising oxalic acid, prior to an etching step. In some embodiments the pretreatment solution is comprised of oxalic acid and water and the concentration of oxalic in the pretreatment solution is in the range of about 1 wt. % to 10 wt. %, or in other embodiments in the range of about 5 wt. % to 8 wt. %.

BRIEF DESCRIPTION OF THE DRAWINGS

The accompanying drawings, which are incorporated in and constitute a part of this specification, exemplify various embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not generally drawn to scale.

DETAILED DESCRIPTION

Embodiments described below disclose etch chemistry and methods to be used for treating metallic surfaces such as in methods of forming flexible circuits, and more particularly for selectively removing electroless nickel from the surface of metallic materials containing copper and optionally stainless steel, methods of etching and pretreatment. As mentioned above the inventors have discovered that a number of complex factors must be understood with respect to the chemistry of the etchant bath in order to solve the aforementioned problems. After substantial study and effort, the inventors have developed an innovative etchant solution that is comprised of a combination of chemicals that preferably act synergistically act to: (1) etch one or more nickel layers on a structure, where the structure includes cooper and optionally stainless steel, (2) remove oxide that forms on the surface of the nickel layers, and (3) reduce etching of the copper as the surface of the copper is exposed. The inventors have discovered that the presence of the stainless steel alters the electrical system within the etchant bath, and that a variety of competing mechanisms must be balanced and promoted in the etchant bath in order to provide effective and desirable selective etching of the electroless nickel layer while reducing or preventing etching of the copper layer, and even in the instance where stainless steel is also present.

Figure 1B:
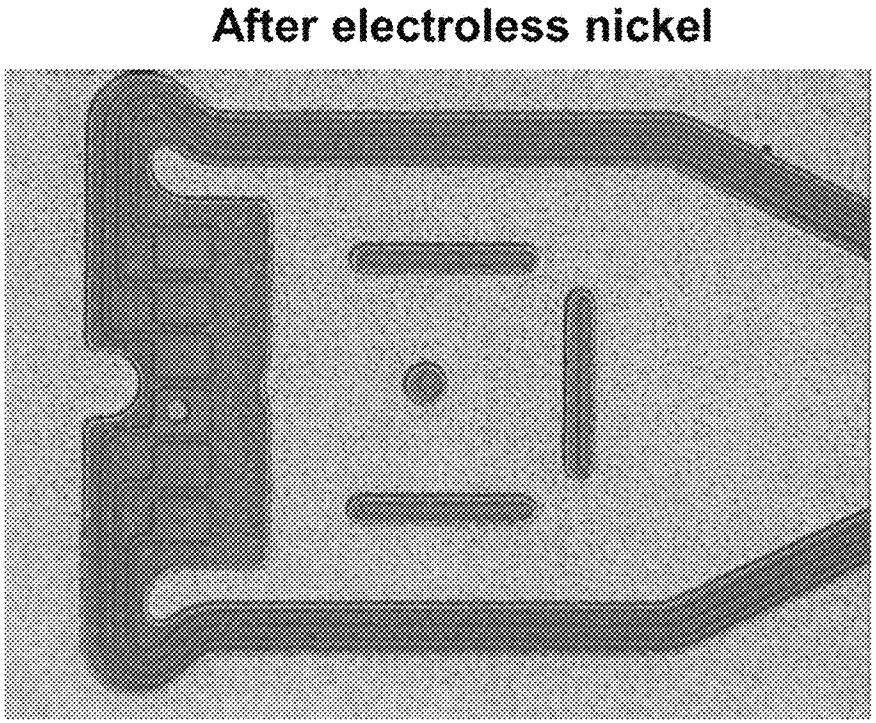
FIGS. 1A and 1B are photographs showing a portion of flexible circuit structure before and after electroless nickel deposition, respectively.
Figure 1A:
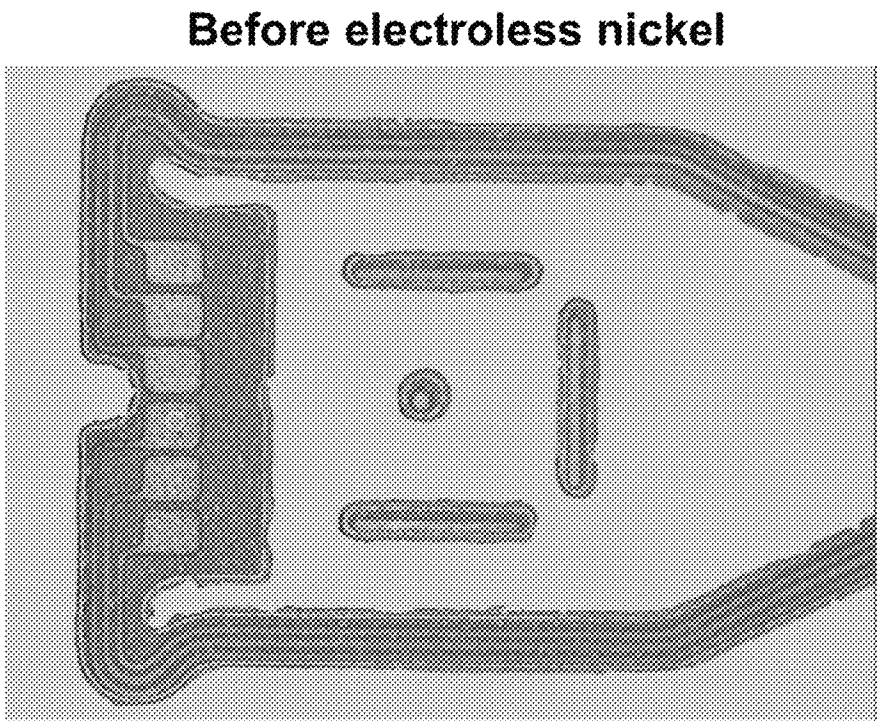
Figure 2:
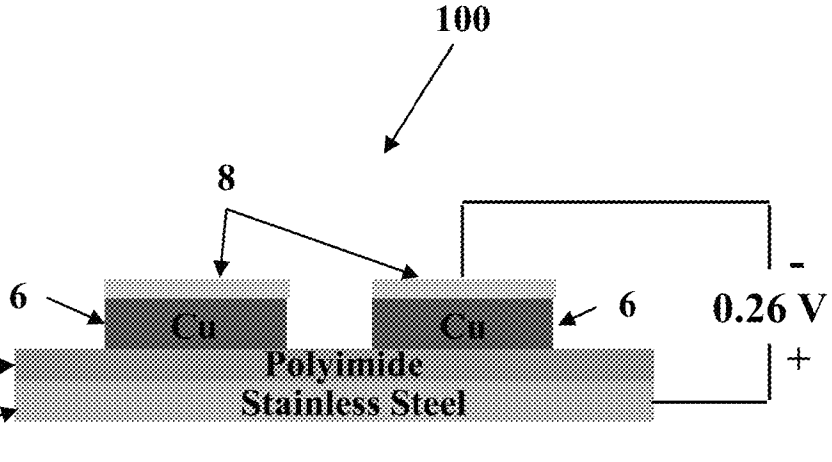
FIG. 2 is a cross-sectional view of a portion of a structure, in this instance a circuit or electronic structure, shown after deposition of electroless nickel on the structure and illustrating the layers in the structure, according to one embodiment.

Turning to the figures, FIG. 1A and FIG. 1B show an electronic structure or component before and after electroless nickel deposition, respectively. Typically, a polyimide overcoat is applied, and then the electroless nickel needs to be removed from the copper traces and stainless steel. FIG. 2 shows a cross section of a portion of an electronic component 100, which generally includes a stainless steel base layer 2, an insulating layer 4 formed atop the stainless steel layer 2, and one or more copper traces 6 formed atop the insulating later 4. The copper traces 6 have been patterned to form a copper layer and are shown in FIG. 2 once they are traces. Atop the copper traces 6 is deposited a layer of electroless nickel 8. The electroless nickel layer 8 prevents a copper oxide from forming on the copper layer. Once the copper traces 6 are formed the electroless nickel layer 8 needs to be removed.

Figure 3:
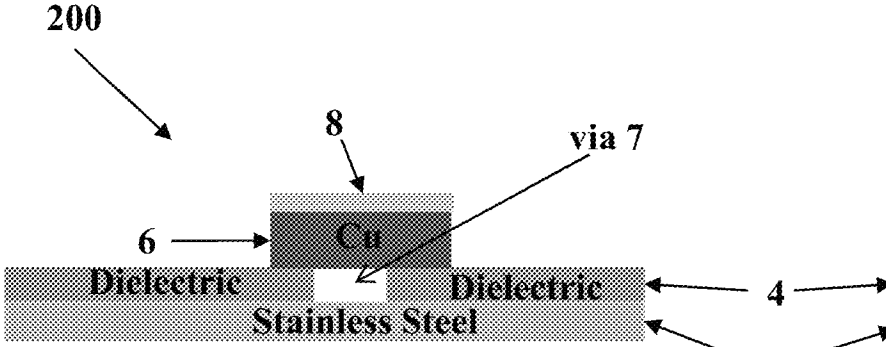
FIG. 3 is a cross-sectional view of a portion of a flexible circuit structure shown after deposition of electroless nickel on the structure and illustrating various layers in the structure, according to another embodiment.

FIG. 3 depicts a cross section of a portion of an electronic component 200 which includes one or more vias 7 which couple the copper trace 6 to the stainless steel layer 2. The electroless nickel layer 8 is also formed on the copper layer in this embodiment and needs to be removed.

In both instances shown in FIGS. 2 and 3, nickel tends to form a tenacious oxide layer 9 which is difficult to remove. As described above, the presence of stainless steel creates galvanic coupling between the nickel and the stainless steel in the etchant bath, thereby creating a battery effect which causes a preference for etching the stainless steel over the nickel.

Etchant Solution

Figure 4:
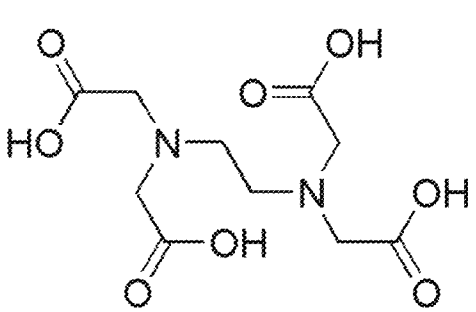
FIG. 4 is a schematic diagram illustrating chemical components of the etchant solution according to some embodiments.
Figure 4:
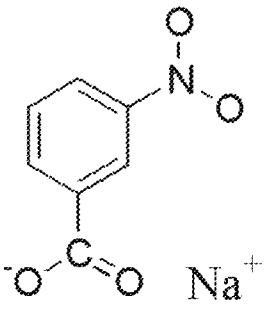

To effectively etch the electroless nickel without damaging the copper traces and in the instance of a structure or substrate containing stainless steel, an etchant solution is used comprised of chemical constituents generally illustrated in FIG. 4. In one example, the etchant solution includes sodium m-nitrobenzoate (NBCA), hydrogen peroxide, and ethylene diamine tetraacetic acid (EDTA).

In some embodiments, the molar concentration of the components in the etchant solution are generally in the range of about 0.5 M to 13 M hydrogen peroxide, 0.3 M to 0.6 M NBCA, and 0.05 M to 0.25 M EDTA. Note that for the higher range of EDTA concentrations, one of ordinary skill in the art may adjust the pH by using combinations of Di-Sodium EDTA and EDTA in order to the prevent higher concentrations of EDTA from defeating the effect of NBCA in the etchant solution, which may start to negatively effect copper etching. It should also be noted that other peroxide compounds may be used in place of hydrogen peroxide. Also, citric acid may be used in place of EDTA in certain applications, provided however that it is stable in the solution as the metal load increases during etching. Further, if citric acid is used as a substitute for EDTA, more citric acid is needed (such as for example twice as much) because citric acid exhibits weaker complexing ability than EDTA. In one non-limiting example, the initial molar concentration of the components in the etchant solution are in the range of about 3.0-4.0 M hydrogen peroxide, 0.4-0.5 M NBCA and 0.05-0.10 M EDTA. Note that in order to maintain desirable etch rates, higher concentrations of EDTA may be needed during etching. This can be achieved for example by continuous additions of certain components to the etchant solution during the etching process. In particular, if metal load during the etching process exceeds the EDTA content in the solution, the peroxide with destroy the organic additives as a Fenton Reagent.

In another non-limiting example the concentration of the components in the etchant solution are about 15.0 wt % hydrogen peroxide, 8.5 wt % NBCA and 1.5 wt % EDTA. Generally, the pH of the etchant solution is in the range of about 4.0 to 5.0.

To improve the bath solubility and stability, additional components may be added to the etchant solution in further embodiments. For example, another suitable pH buffer such as mono sodium phosphate may be added to raise the pH slightly and maintain NBCA solubility. The pH buffer can be added up to amount which does not cause peroxide instability.

In another example, the concentration of the components in the etchant solution are generally in the range of about 1.9 vol % to 2.35 vol % hydrogen peroxide, 0.175 M to 0.235 M NBCA and 0.02 M to 0.04 M EDTA.

Figure 5A:
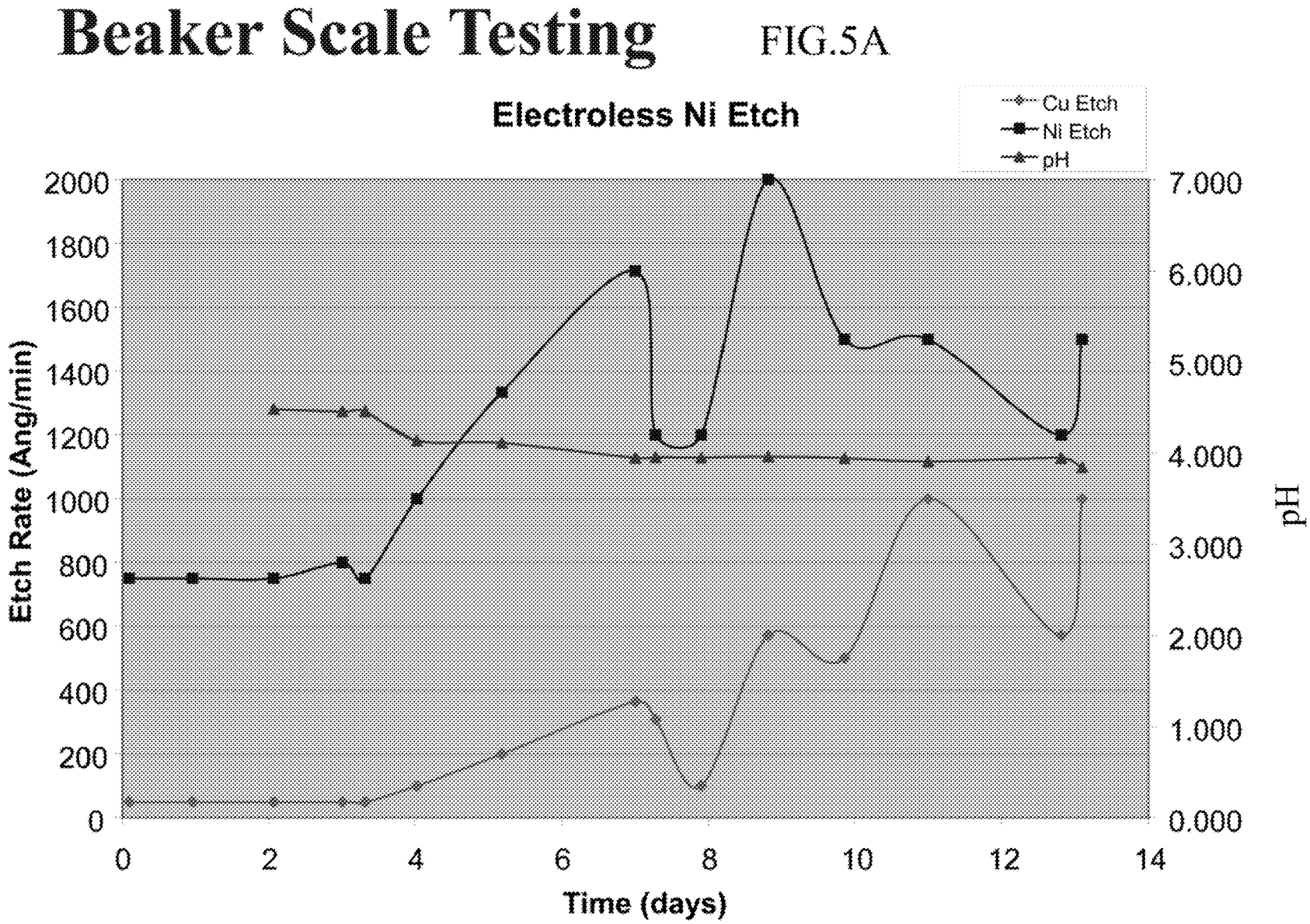
FIG. 5A is a graph of etch rate as a function of time and showing the progression of etching on copper and nickel layers according to embodiments of the present disclosure.

FIG. 5A shows the etch rate achieved with the etchant solution and method of the present disclosure as a function of time and showing the progression of etching on copper and nickel layers. As illustrated, the etchant selectively etches the electroless nickel layer without substantial attack on the copper.

Etching Methods

Embodiments of the present disclosure further provide methods of removing or etching electroless nickel on at least one surface of a substrate or structure wherein the substrate or structure includes copper, and optionally stainless steel, using an etchant solution comprised of hydrogen peroxide, sodium m-nitrobenzoate (NBCA) and ethylenediamine tetra acetic acid (ED TA).

The etchant and methods of removing electroless nickel described herein are suitable for substrates that include only copper, however as described above the etchant and methods of removing electroless nickel are also suitable when the substrate includes stainless steel and copper. While the presence of an electrically connected copper and stainless steel layers does affect the overall etch rate of the electroless nickel on the copper feature(s), the etchant described herein is still suitable and desired when there is not an electrical connection between the stainless steel and cooper. In particular, the etchant formulation described in the present disclosure is needed due to the stack-up of electroless nickel that occurs on the copper, whereas the prior art etchants will aggressively attack the copper under the electroless nickel.

In one example, the etching process is carried out at a temperature from about 25 to about 55° C. The temperature assists in providing a desirable etch rate. In some examples, depending on the thickness of the electroless nickel to be etched, the etching process is carried out for a time of about 1 to 15 minutes. In one example, for a thickness of electroless nickel of about 150 nm, the etching process is carried out for a time of about 1 to 3 minutes.

Figure 5B:
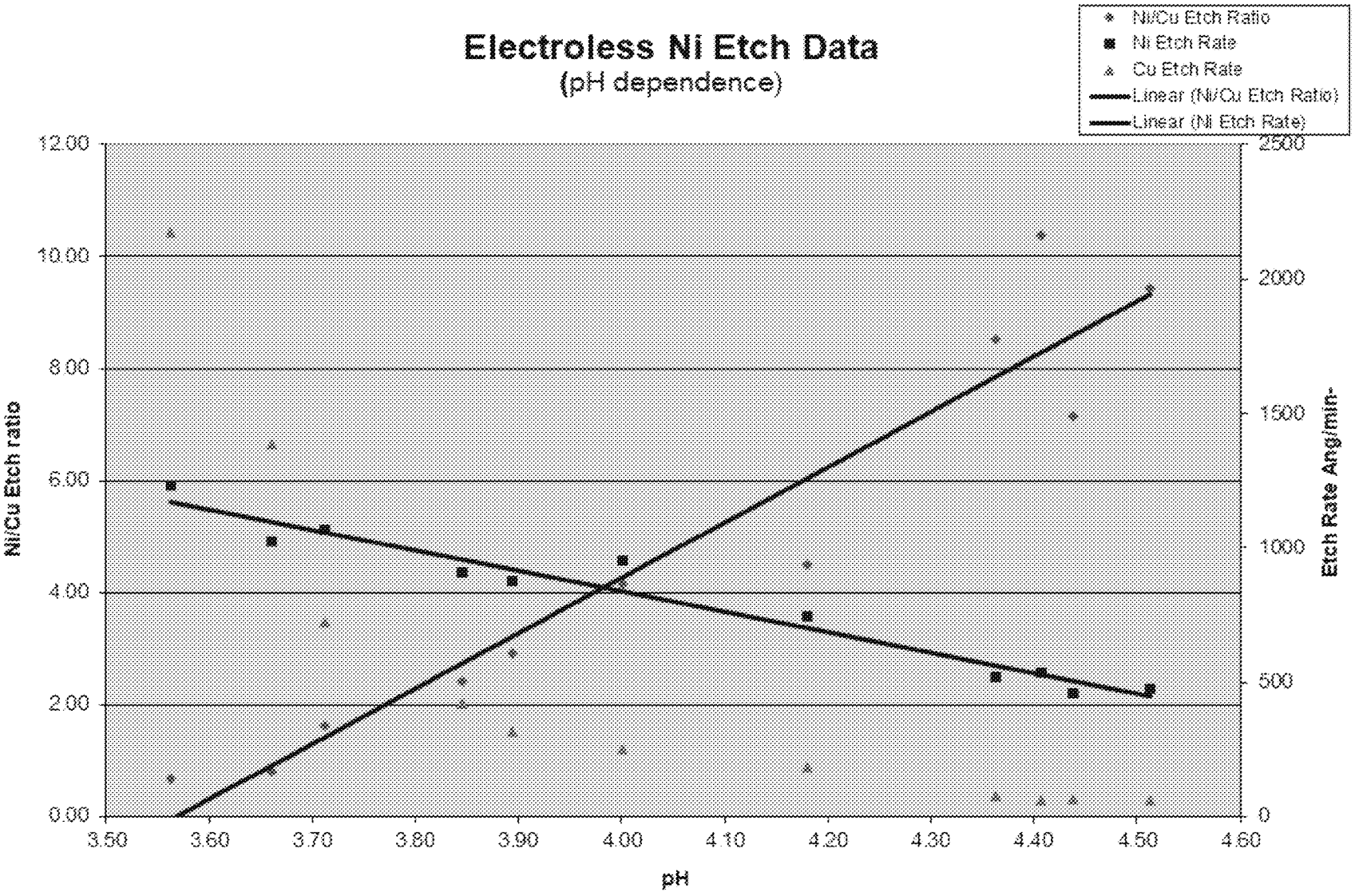
FIG. 5B is a graph showing etch rate dependence on pH according to embodiments of the present disclosure.

FIG. 5B illustrates etch rates of electroless nickel and copper as a function of pH of the etchant solution. As suggested by the data, it is preferable to maintain the pH of the etchant solution at 3.9 and above. Etch rates achieved using the etch solution are generally from about to about 25 nm/min to about 150 nm/min and, more specifically from about 25 nm/min to about 75 nm/min, at a pH of above 3.9.

In a non-limiting example according to one method, the molar concentration of the components in the etchant solution are generally in the range of about 0.5 M to 13 M hydrogen peroxide, 0.3 M to 0.6 M NBCA, and 0.05 to 0.25 M EDTA. In one non-limiting example, the initial molar concentration of the components in the etchant solution are in the range of about 3.0-4.0 M hydrogen peroxide, 0.4-0.5 M NBCA and 0.05-0.10 M EDTA. One or more of the components of the etchant solution may be added to during etching, such as in a continuous manner, in order to maintain desired concentrations during the etching process as metal load increases.

In another non-limiting example the concentration of the components in the etchant solution are about 15.0 wt % hydrogen peroxide, 8.5 wt % NBCA and 1.5 wt % EDTA, and the etchant solution has a pH in the range of about 3.9 to 5.0. When stainless steel is present, the stainless steel will be exposed without damage to the etchant for the entire process of removing electroless nickel from the copper traces.

The etchant solution of the present disclosure is suitable for processes in which a structure or substrate having a metal surface and containing stainless steel (such as but not limited to a flexible circuit, flexure, or other electronic component) is immersed in the etchant solution. In some embodiments, the substrate is carried on a continuous web and is exposed to the etchant solution in a roll-to-roll continuous process. The etchant solution may be sprayed onto the substrate by one or more spray nozzles as the web is conveyed. Alternatively, the web may carry the substrate through a bath containing the etchant solution such that the substrate is immersed or dipped in the etchant solution.

In other embodiments, a batch process is used where the structure is immersed or dipped in an individual bath containing the etchant solution.

Pretreatment Solution and Methods

In another aspect, a pretreatment method may be applied to the surface of a substrate or structure prior to electroless nickel etching. The inventors have discovered a unique pretreatment process that enhances the etching of electroless nickel on a substrate that includes stainless steel, and in particular improves removal of oxide that forms on the nickel. For example, in some embodiments it is observed that when first pretreating the substrate, the etch rate of the electroless nickel was increased by 2-times and greater than the etch rate achieved without the pretreatment step carried out at the same temperature. In some situations the effect is as great as 4-times faster. Further, the inventors have discovered that when oxalic acid is used in the pretreatment methods, the oxalic acid is good for removing free iron from the surface of stainless steel. This not only cleans and brightens the steel, but also passivates the surface. Passivation reduces negative effects of the previously described interactions steel has with the etching of electroless nickel. It makes the steel more inert. These enhanced effects were unexpected.

Generally, the pretreatment solution is comprised of oxalic acid and water. In some embodiments, the concentration of oxalic in the pretreatment solution is in the range of 1 wt. % to 10 wt. %, or in other embodiments in the range of about 5 wt. % to 8 wt. In an alternative embodiment, the pretreatment solution my include citric acid.

The pretreatment solution is applied to the substrate containing stainless steel prior to the etching step. The pretreatment solution is not stable in the etchant solution and thus is applied in a separate step. Generally, the pretreatment solution is applied in a pretreatment process where the substrate is exposed to the pretreatment solution for a time of about 1 to 2 minutes at a temperature of about 25° C., and for a time of about 10 seconds to 1 minute at a temperature of about 40° C.

EXAMPLES

The present invention is more particularly described in the following examples that are intended as illustration only, since numerous modifications and variations within the scope of the present invention will be apparent to those skilled in the art.

In one example, the method is carried out by immersing an article with a portion to be etched into a pretreat bath for 1 minute. The solution alternatively could be sprayed on in either a horizontal or vertical orientation. The pretreatment may be rinsed off if desired but not necessary. In either case it is important to not allow the article to dry. Drying reforms to oxide and the activation is lost. Leaving the article in rinse water will also reform the oxide though not as fast. One has a limit of about a minute to go from pretreat to etch bath. The etch bath may be sprayed or the article immersed. Vigorous agitation is needed to bring EDTA to the surface to prevent the peroxide from passivating the nickel and greatly slowing the etch rate.

Example Structures

As discussed above, the etch solution and etching process disclosed herein is used in the manufacture of a variety of electronic components or structures. In some embodiments, the etch solution and etching process disclosed herein is used in the manufacture of flexures of a hard disk drive suspension, such as a suspension of U.S. Pat. No. 9,296,188 or U.S. Pat. No. 8,891,206, or in the manufacture of a SMA-OIS assembly of U.S. Pat. No. 9,541,769, all of which are hereby incorporated by reference in their respective entireties.

Figure 6:
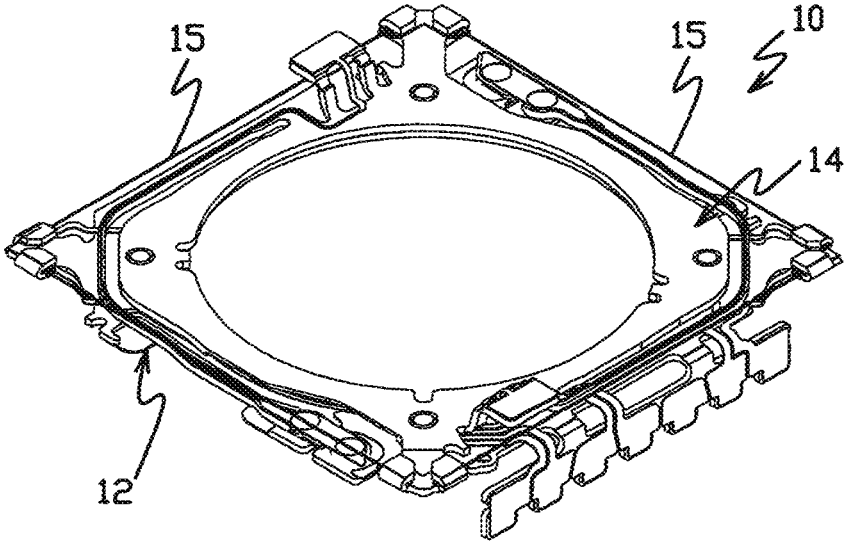
FIG. 6 is a top isometric view of a flexible printed circuit comprised of a shape memory alloy optical image stabilization (SMA-OIS) suspension formed in part according to some embodiments of the present disclose.

For example, referring to FIG. 6 shows an example of a flexible circuit that may be formed in part using the etchant solution and etching method of the present disclosure. Optionally, the pretreatment solution and method may be applied prior to the etching step. The invention is also suitable in improving layer-to-layer via performance in circuits.

In the exemplary embodiment illustrated in FIG. 6, a flexible printed circuit is comprised of a shape memory alloy optical image stabilization (SMA-OIS) suspension assembly 10 having a flexible printed circuit or support member 12 and a spring crimp circuit or moving member 14 that is coupled to the support member 12. Shape member allow wires 15 extend between the support member 12 and the moving member 14 and can be electrically actuated to move and control the position of the moving member 14 with respect to the support member 12. Assembly 10 is a suspension assembly of a camera lens optical image stabilization device that may be used in mobile devices such as mobile phones, tablets and laptop computers.

Figure 7:
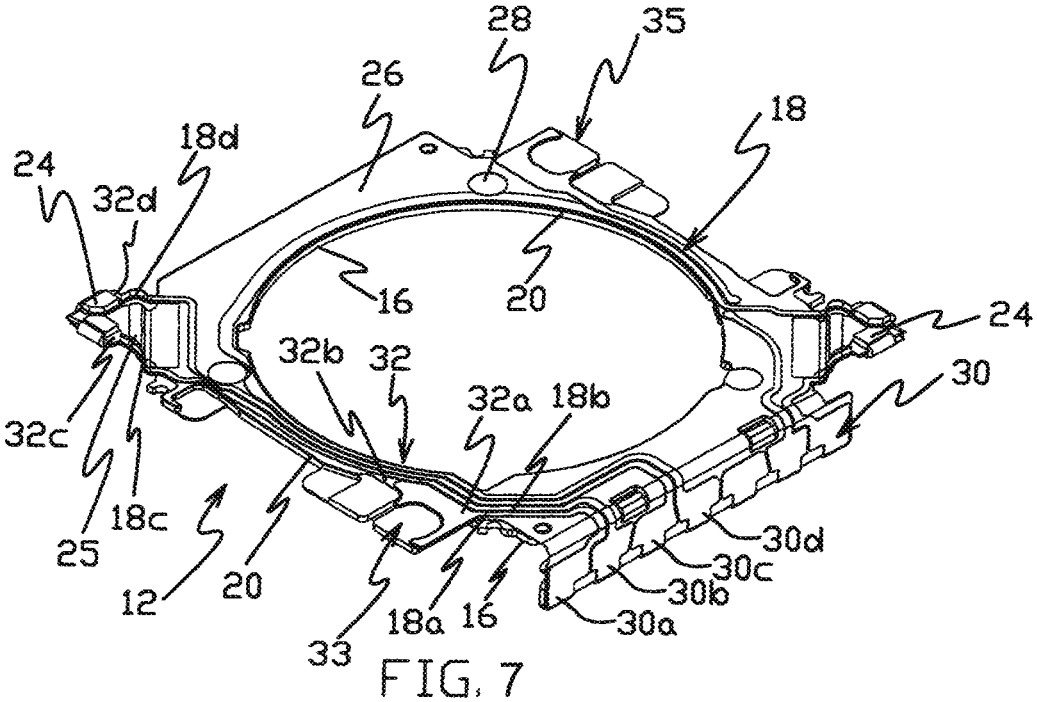
FIG. 7 is a top isometric view of the support member of the SMA-OIS suspension shown in FIG. 6.

FIG. 7 illustrates the support member 12 of the SMA-OIS suspension shown in FIG. 6 in more detail. In the exemplary embodiment, the support member 12 includes a base layer 16 and one or more conductive traces 18, such as conductive traces 18*a*-18*d* in a conductor layer on the base layer 16. A layer of dielectric 20 is located between the conductive traces 18 and the base layer 16 to electrically insulate the traces from the base layer 16, which can be metal such as stainless steel. One or more wire attachment structures such as crimps 24 are located on the base layer 16. In the illustrated embodiment the crimps 24 are organized as two pairs of adjacent structures that are integrally formed on a ledge 25 in the base layer 16 at a level spaced (e.g., in a z-direction) from a major planar surface portion 26 of the base layer. Other embodiments may include other wire attach structures (e.g., solder pads) and/or wire attach structures that are organized in other arrangements (e.g., singly rather than in pairs). In one example bearing-retaining recesses 28 are formed in the portion 26 of base layer 16, and bearings in the recesses 28 can engage the moving member 14 and movably support the moving member with respect to the support member 12.

The conductive traces 18 include terminals 30 and contact pads 32 in the conductor layer on the base layer 16. Each of the traces 18 couples a terminal 30 to a contact pad 32. For example, contact pads 32*a* and 32*b* are at a first mount region 33 of the support member 12, and traces 18*a* and 18*b* couple terminals 30*a* and 30*b* to pads 32*a* and 32*b*, respectively. Contact pads 32 at a second mount region 35 are similarly coupled to terminal 30 by traces 18. A contact pad 32 is located at each of the crimps 24 in the illustrated embodiment, and each of the contact pads is coupled by a separate trace to a separate terminal 30 (e.g., trace 18*d* couples terminal 30*d* to pad 32*d*). The portion of the base layer 16 on which the terminals 30 are located is formed out of the plane of the major surface portion 26 (e.g., perpendicular to the plane of the major surface portion in the illustrated embodiment). In the illustrated embodiment, the crimps 24 are unitary with and formed from the same piece of material of the base layer 16 as the surface portion 26.

Figure 8:
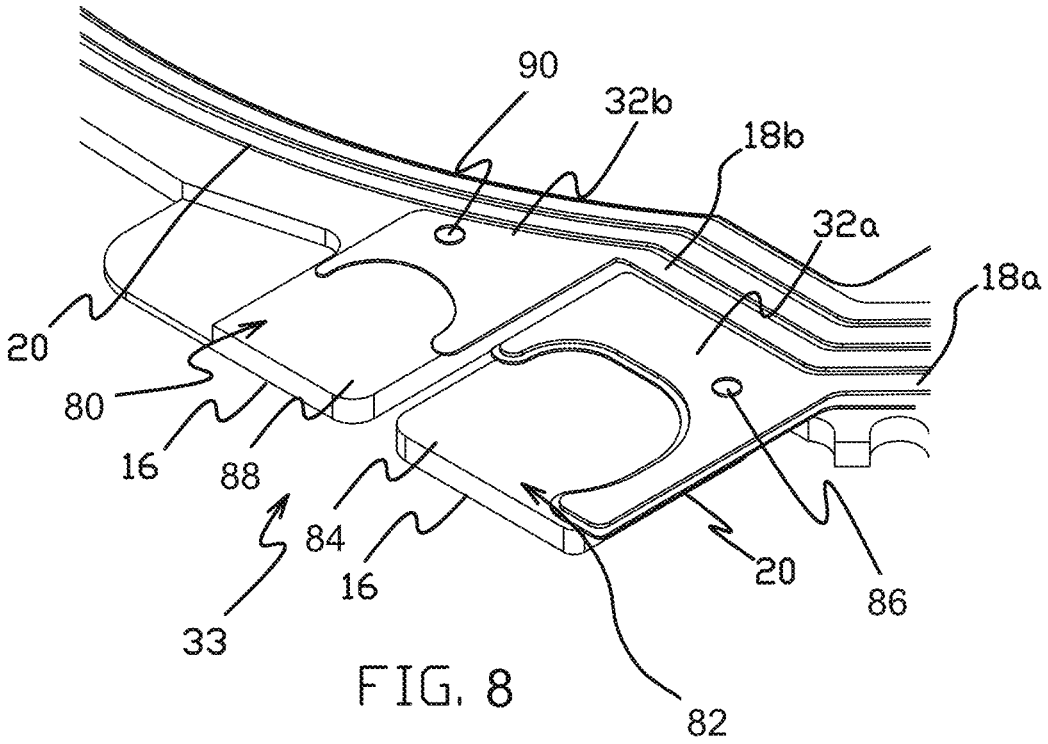
FIG. 8 is a partial top isometric view of a mount region of the support member shown in FIG. 7 showing conductive traces formed according to some embodiments of the present disclosure.

FIG. 8 illustrates the mount region 33 of the support member 12 in greater detail. As shown, the mount region 33 includes first and second mounting pads 80 and 82. Mounting pad 82 includes an island or pad portion 84 in the base layer 16 that is electrically isolated from other portions of the base layer. The island pad portion 84 can be supported in part from adjacent portions of the base layer 16 by areas of dielectric 20 that extend between the island pad portion and adjacent portions of the base layer. Trace 18*a* and contact pad 32*a* extend to the island pad portion 84, and in embodiments are electrically connected to the island pad portion 84 by an electrical connection such as a plated or other via 86 that extends through the dielectric 20 at the mounting pad 82. Other embodiments include other electrical connections in place of or in addition to via 86, such as, for example, conductive adhesive that extends between the contact pad 32*a* and island pad portion 84 over the edges of the dielectric 20. Mounting pad 80 is adjacent to mounting pad 82, and includes a pad portion 88 in the base layer 16 (that in embodiments functions as an electrical ground or common structure), and an electrical connection such as via 90 that connects the contact pad 32*b* to the pad portion 88.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A method of removing electroless nickel on at least one surface of a substrate, the substrate including copper and optionally stainless steel, comprising the steps of: exposing the substrate to an etchant solution comprising hydrogen peroxide, sodium m-nitrobenzoate (NBCA) and ethylenediamine tetra acetic acid (EDTA); and etching the electroless nickel on the surface of the substrate to remove the electroless nickel.

2. The method of claim 1 wherein the etching step does not substantially remove the copper relative to removal of the electroless nickel.

3. The method of claim 1 wherein the etching step is carried out at a temperature from about 25 to about 55° C.

4. The method of claim 1 wherein the etching step is carried out for a time of about 1 to 15 minutes.

5. The method of claim 1 wherein the electroless nickel is etched at an etch rate of about to about 25 nm/min to about 150 nm/min at a pH of above 3.9.

6. The method of claim 1 wherein the etchant solution has a molar concentration in the range of about 3.0-4.0 M hydrogen peroxide, 0.4-0.5 M NBCA and 0.05-0.10M EDTA.

7. The method of claim 1 wherein the etchant solution wherein the has a concentration of about 1.9 vol % to 2.35 vol % hydrogen peroxide, 0.175M to 0.235M NBCA and 0.02M to 0.04M EDTA.

8. The method of claim 1 wherein the etchant solution has a concentration of about 15.0 wt % hydrogen peroxide, 8.5 wt % NBCA and 1.5 wt % EDTA.

9. The method of claim 1 wherein the substrate is exposed to the etchant solution by any one or more of: immersing, spraying or dipping.

* * * * *